US006253822B1

(12) United States Patent
Wootton

(10) Patent No.: US 6,253,822 B1
(45) **Date of Patent: *Jul. 3, 2001**

(54) CORD DRIVING MECHANISM FOR A BLIND

(75) Inventor: Malcolm James Wootton, Bridge of Weir (GB)

(73) Assignee: Eclipse Blind Systems Limited, Renfrew (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/142,324

(22) PCT Filed: Mar. 7, 1997

(86) PCT No.: PCT/GB97/00626

§ 371 Date: Dec. 18, 1998

§ 102(e) Date: Dec. 18, 1998

(87) PCT Pub. No.: WO97/33064

PCT Pub. Date: Sep. 12, 1997

(30) Foreign Application Priority Data

Mar. 7, 1996 (GB) ..... 9604861

(51) Int. Cl.[7] ..... E06B 9/26
(52) U.S. Cl. ..... 160/168.1 P; 160/319
(58) Field of Search ..... 160/319, 320, 160/120, 405, 168.1 P, 176.1 P, DIG. 17

(56) References Cited

U.S. PATENT DOCUMENTS

| | | | | |
|---|---|---|---|---|
| 3,630,264 | * | 12/1971 | Debs et al. | 160/177 R |
| 4,227,423 | | 10/1980 | Crowe | 474/177 |
| 4,413,981 | | 11/1983 | White et al. | 474/94 |
| 4,418,739 | * | 12/1983 | Woolnough et al. | 160/120 |
| 4,834,164 | * | 5/1989 | Tuhey | 160/319 |
| 5,137,073 | * | 8/1992 | Huang | 160/319 X |
| 5,332,195 | | 7/1994 | Sugiyama | 254/371 |
| 5,361,822 | * | 11/1994 | Nijs | 160/321 |

FOREIGN PATENT DOCUMENTS

| | | |
|---|---|---|
| 3423230 | 1/1986 | (DE) . |
| 1414 338 | 11/1975 | (GB) . |
| 1459 053 | 12/1976 | (GB) . |
| 2 179 387 | 3/1987 | (GB) . |
| 2179907 | 3/1987 | (GB) . |
| 2 157 753 | 10/1995 | (GB) . |

* cited by examiner

*Primary Examiner*—David M. Purol
(74) *Attorney, Agent, or Firm*—Bromberg & Sunstein LLP

(57) ABSTRACT

A cord driving mechanism for a blind is described, which comprises a cord driving pulley having a circumferential, radially outward-facing groove comprising a plurality of nips, the nips defined by formations which are disposed opposite one another on respective sides of the groove and are positioned so that the path of a cord around the pulley is relatively straight and so that the cord is substantially unconstricted in the regions between the nips; and a shoe, relative to which the pulley rotates, which surrounds at least part of the circumferential groove in the pulley. A cord passes around the pulley, in the space defined by the circumferential groove and the shoe. The cord is retained in the groove by contact with the shoe. The dimensions of the groove, the spacing between the groove and the shoe, and the size of the cord provide a desired resistance to rotation of the pulley and a desired maximum load which can be exerted on the cord.

20 Claims, 5 Drawing Sheets

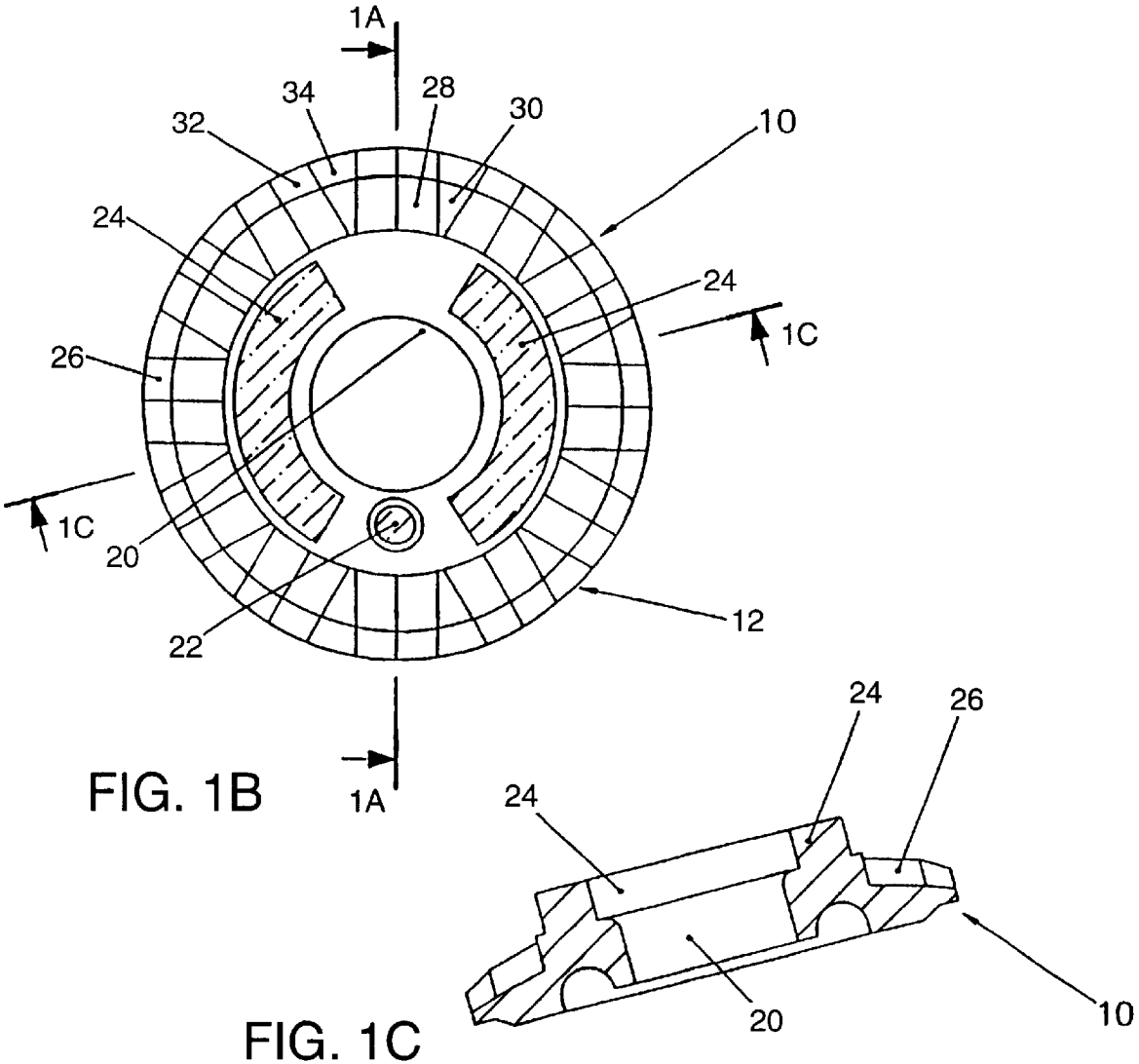
FIG. 1B
FIG. 1C
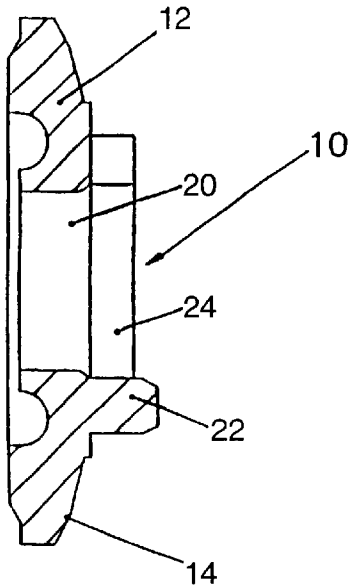
FIG. 1A

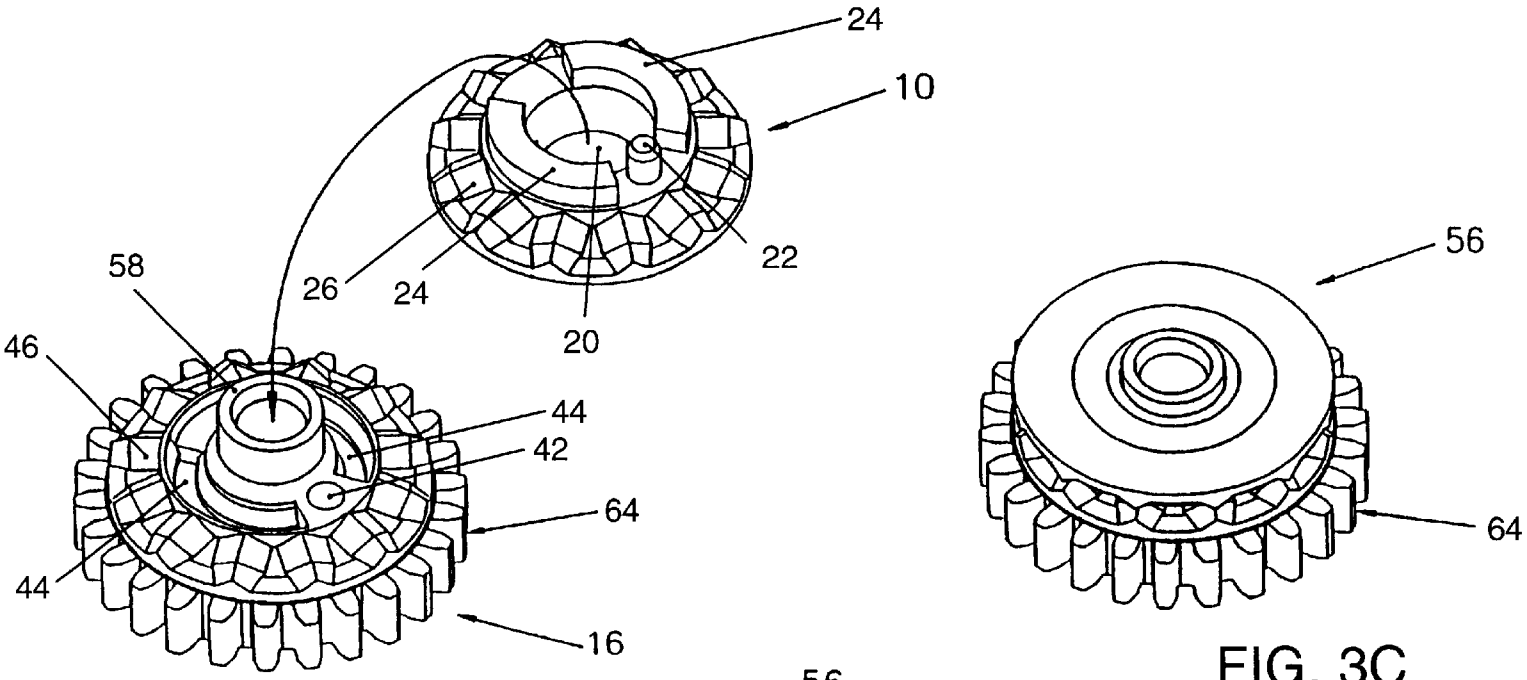
FIG. 3C
FIG. 3A
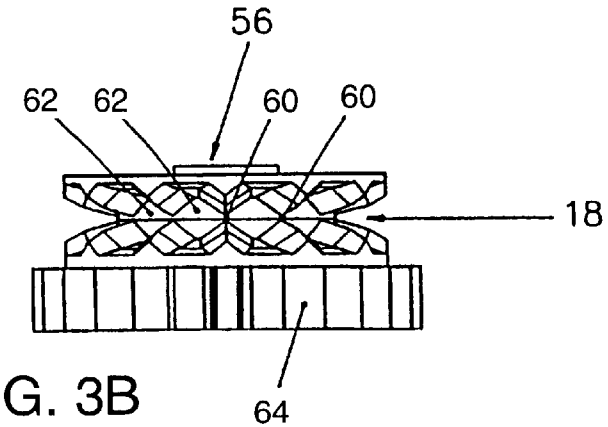
FIG. 3B

CORD DRIVING MECHANISM FOR A BLIND

CROSS-REFERENCE TO RELATED APPLICATION

This application claims the benefit of International application number PCT/GB97/00626, filed on Mar. 7, 1997, and published as WO 97/33064, which in turn claims the benefit of UK application GB 9604861.6, filed on Mar. 7, 1996.

FIELD OF THE INVENTION

This invention relates to powered blinds of the type which includes an operating cord entrained around a powered driving pulley. In the case of vertical blinds, the cord may operate the open/close function of the blind.

BACKGROUND

Power is delivered to the pulley from an electric motor via a gearbox and rotation of the pulley tends to entrain the cord, thus operating the blind. However, to ensure that the cord is reliably gripped by the pulley, it has hitherto been found necessary to ensure that the cord is tensioned in its passage around the pulley. Clearly, once the pulley begins to drive the cord, there will be a certain amount of tension in the cord upstream of the pulley, but it has been found that tension (additional to that resulting from the weight of the cord itself) is required both upstream and downstream of the pulley to ensure that as the pulley begins to rotate, it takes the cord with it. This will be referred to as "back-tensioning" of the cord. It gives rise to excessive wear on the pulley bearings and increases the drag of the mechanism, thereby increasing the motor current required to drive the blinds Furthermore, the task of assembling the driving mechanism of the blind requires a degree of dexterity, since the cord must be kept properly positioned relative no the pulley until the cord can be tensioned to keep it in place.

SUMMARY

It is an object of the present invention to address the problems outlined above.

According to a first aspect of the present invention, there is provided a cord driving mechanism for a blind comprising a cord driving pulley having a circumferential, radially outward-facing groove and a shoe, relative to which the pulley rotates, surrounding at least part of the circumferential groove in the pulley. The advantages of this arrangement are twofold. Firstly, the shoe will retain the cord positioned correctly with respect to the pulley during the manufacturing process. Secondly, the shoe can be arranged to bear against the cord to ensure that it is properly gripped by the pulley as the pulley begins to rotate in service. The net result is that much less, or no, back-tension is required, the pulley bearings will last longer and the drag of the mechanism will be considerably reduced.

For extra security, it is preferred that the shoe should surround at least half of the circumference of the pulley. This has further advantages which will be explained later.

In a preferred arrangement, a plurality of nips are distributed around the circumferential groove of the pulley. These nips pinch the cord as it passes around the pulley, ensuring a further improvement in the ability of the pulley to grip the cord. Each of the nips is preferably radial within the groove. The nips are preferably spaced equidistantly around the circumferential groove.

To ensure that at least one nip grips the cord at any time, there should be at least four. For example, there may be twelve.

To ensure a good grip on both sides of the cord, it is preferred that the nips be defined by formations on both sides of the circumferential groove. For example, the formations defining each nip may be opposite one another on each side of the groove. This arrangement keeps the path of the cord relatively straight and provides unconstricted regions between nips, one advantage of which will be described later.

The formations may be triangular teeth and are preferably symmetric, since the pulley will need to drive the cord in both directions.

The mechanism is preferably arranged to be self-threading (as will be described later).

For reasons which are self-evident, the mechanism will benefit from a doctor arranged adjacent the circumferential groove in the pulley and adapted to guide the cord out of the groove when the pulley is rotated. Again, as two directions of rotation are required, the doctor is preferably substantially symmetric. For reasons which will be explained later, the doctor may define an insertion opening for the cord.

According to a second aspect of the invention, there is provided a blind including a cord driving mechanism comprising a pulley having a circumferential, radially outward-facing groove and a shoe, relative to which the pulley rotates, surrounding at least part of the circumferential groove in the pulley and further including a cord which passes around the pulley, in the space defined by the circumferential groove and the shoe. The cord driving mechanism is preferably as described above as being in accordance with the invention. The pulley is adapted to drive the cord which is, in turn, adapted to operate moving parts of the blind, such as the traverse or tilt mechanisms.

Preferably, the cord is not back-tensioned in normal use and this can best be achieved by arranging for it to be retained in the groove by contact with the shoe. The dimensions of the groove and/or the spacing between the groove and the shoe and/or the size of the cord may be selected to provide a desired resistance to rotation of the pulley and/or a desired maximum load which can be exerted on the cord.

A third aspect of the present invention provides a cord driving pulley for a blind having a circumferential, radially outward-facing groove around which are distributed a plurality of nips A fourth aspect of the present invention provides a method of installing a cord in a cord driving mechanism of a blind comprising a cord driving pulley having a circumferential, radially outward-facing groove and a shoe, relative to which the pulley rotates, surrounding at least part of the circumferential groove in the pulley, comprising offering a free end of the cord to the space defined by the circumferential groove and the shoe and rotating the pulley to entrain the cord. This is a much simpler method than that currently in use. Because this method is envisaged, it is better for the shoe to surround as much of the circumference of the pulley as will carry cord in normal use, i.e. over half of it.

Where the mechanism includes a doctor arranged adjacent the circumferential groove in the pulley and adapted to guide the cord out of the groove when the pulley is rotated, the method will further comprise retrieving the free end of the cord once it has passed around the pulley and is freed by the doctor.

Where, as described above, the doctor defines an insertion opening for the cord, the free end of the cord will be offered up to that opening. Similarly, where a plurality of nips are distributed around the circumferential groove, the free end of the cord will be offered up to the region of the groove between two of the nips.

BRIEF DESCRIPTION OF THE DRAWINGS

The present invention will now be described by way of example with reference to FIGS. 1A through 5 of the accompanying drawings, in which:

FIGS. 1A through 1C show one half of a molded pulley;

FIGS. 3A through 3C are an assembly drawing of the pulley;

DETAILED DESCRIPTION

Figure 2B:
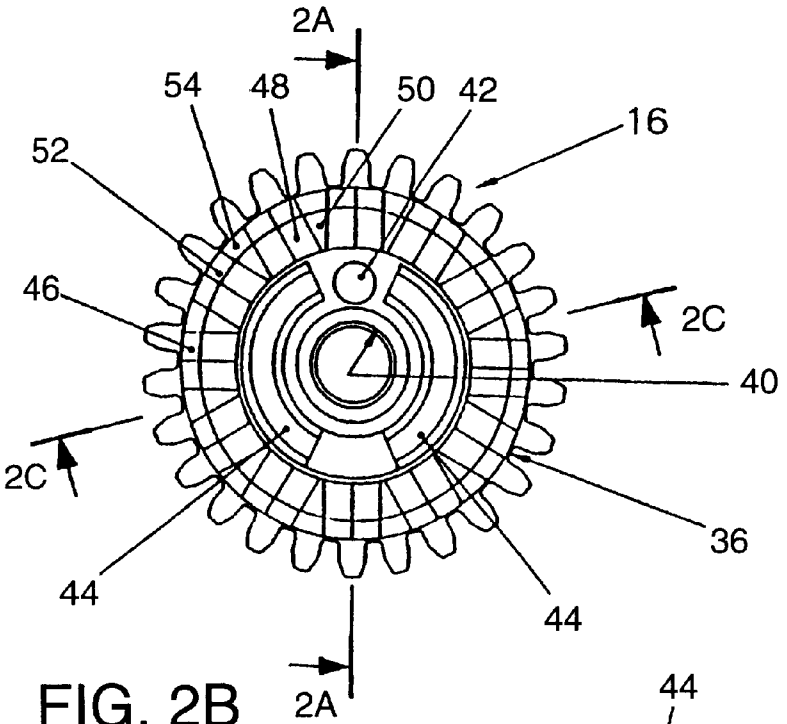
FIGS. 2A through 2C show the other half of a molded pulley.
Figure 2C:
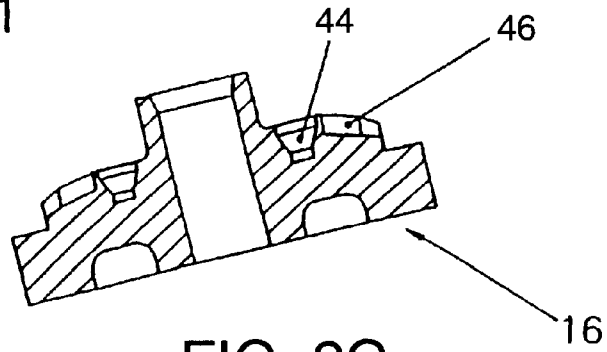
Figure 2A:
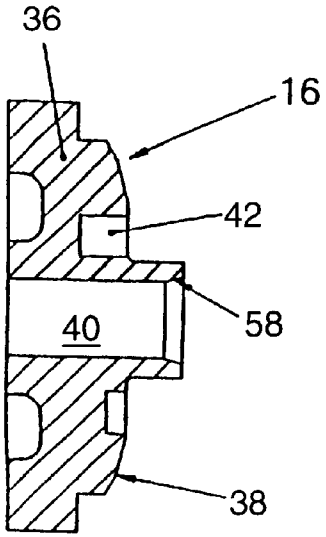

The half pulley 10 illustrated in FIGS. 1A through 1C comprises a flange 12, shaped on one side 14 so as, in cooperation with the other half pulley 16 illustrated in FIGS. 2A through 2C, to provide a "V"-shaped groove 15 in the finished product, as illustrated in FIGS. 3A through 3C. A central cylindrical bore 20 is provided in the flange, together with locating features in the form of a pin 22 and a pair of part-cylindrical bosses 24. The side 14 of the flange 12 which forms one half of the "V"-shaped groove includes twelve symmetric, triangular teeth 26. The teeth and the flange have central, relatively shallowly inclined surfaces 28, 30 and distal, relatively sharply inclined surfaces 32, 34. These help the teeth 26 and the groove 18 to grip the cord (not shown).

The half pulley 16 illustrated in FIGS. 2A through 2C also comprises a flange 36, shaped on one side 38 so as to cooperate with the other half pulley 10 illustrated in FIGS. 1A through 1C. A central bearing surface in the form of a cylindrical bore 40 is provided in the flange, continuing into a central boss 58, together with locating features in the form of a recess 42 and a pair of part-cylindrical detents 44. Again, the side 38 of the flange 36 which forms one half of the "V"-shaped groove includes twelve symmetric, triangular teeth 46. The teeth and the flange have central, relatively shallowly inclined surfaces 48, 50 and distal, relatively sharply inclined surfaces 52, 54.

The teeth 26, 46 in both pulley halves can be seen to be radially directed. It is for this reason that the pulley is manufactured in two halves 10, 16. If this were not so, there would need to be as many removable cores in the mold as there are teeth on the pulley, twelve in this example. This would increase both tooling and production costs. A two part molding is used to allow radial teeth, since it is clear that, in a pulley which must grip efficiently and operate in both directions, radial teeth are to be preferred.

The assembly of the pulley 56 is shown in FIGS. 3A through 3C. As will be understood, on assembly, the central boss 58 will be received in the bore 20; the pin 22 will go into the recess 42: and the bosses 24 will go into the detents 44. In this way the teeth 26 will line up exactly with the teeth 46, to provide a series of nips 60, separated by spaces 62. The finished pulley has an integral gear 64, molded integrally with the second half 16. The two halves may be ultrasonically welded together, although care must be taken to prevent distortion, or may be glued together. In either case, the amount of pressure applied will vary the separation between the teeth 26, 46, which may be significant.

The choice of material for the pulley and the choice of material for the cord are important. A balance must be struck between the need for good grip between the pulley and the cord and a desire to reduce abrasion of the cord. The presently preferred material for the pulley is DuPont's Minlon 23B1, a 37% mineral-glass-reinforced PA (nylon) 66 (28% mineral, 9% glass). This combines well with a 2.5 mm nominal diameter smooth braided polyester cord with polyester filler, such as are well known to those skilled in the art of blind making.

An important advantage of the present invention can be appreciated from its ability to use unmodified polyester cords. Most motorised blinds use a drive train which can be described as incorporating a "positive drive" member. This member may take the form of a ball chain or an apertured tape or a helical drive shaft. The present invention takes advantage of unmodified cords, which it is able to do by virtue of its unique non-tensioned and self-threading construction. It is therefore applicable to the conversion of manual blinds to motorised form, not so much as an after-market accessory, but rather as a convenient way for manufacturers to modify their own products. This carries with it substantial development cost advantages, as there is no need to modify the perfectly good mechanism of a manual blind to accommodate any modified motorised drive train.

Figure 4C:
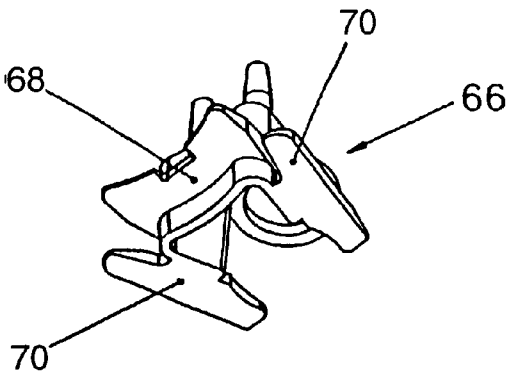
FIGS. 4A through 4C show a molded doctor.
Figure 4A:
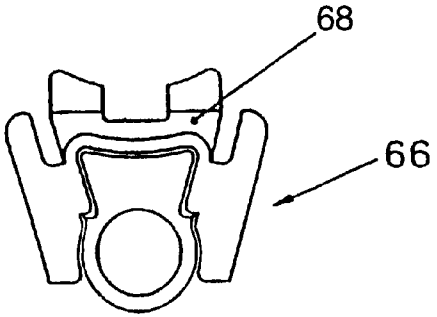
Figure 4B:
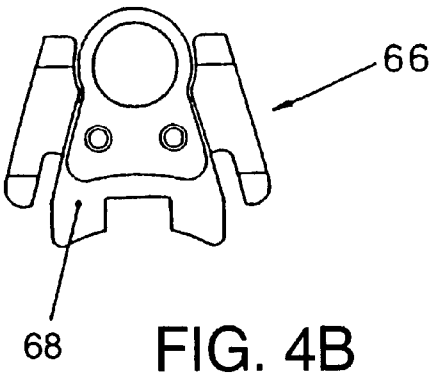

FIGS. 4A through 4C illustrate a doctor 66. The doctor 66 includes a blade 68 which goes between the two parts 10, 16 of the pulley 56 to guide the cord out of the groove 18. It also includes a pair of wings 70, the purpose of which will become apparent.

Figure 5:
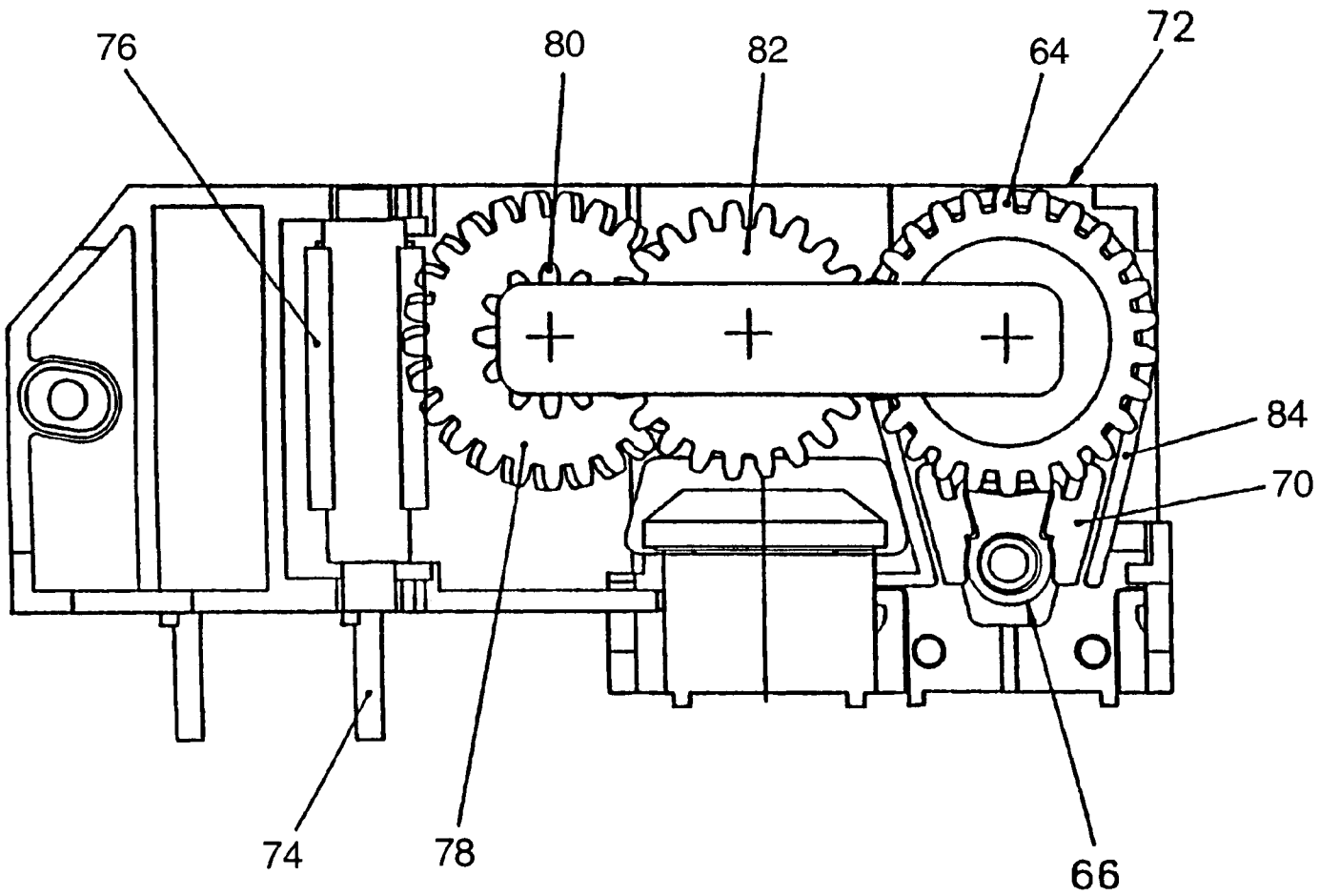
FIG. 5 is an assembly drawing of a gearbox.

FIG. 5 shows an assembled gearbox 72. A spindle 74 is driven by a motor (not shown). Attached to the spindle 74 is a worm 76, which drives a helical gear 78. The helical gear then transmits drive via a reduction gear 80 and an idle gear 82 to the gear 64 on the pulley 56. Closely surrounding over one half of the circumference of the pulley 56 is a shoe 84, the two free ends of which run parallel and close to the edges of the wings 70 of the doctor 66. The doctor blade 68 is located in the "V"-shaped groove of the pulley 56.

The wings 70 of the doctor 66 define, in conjunction with the gearbox housing and the shoe 84, an insertion aperture for the cord on each side of the pulley 56. Installing the cord onto the pulley is simplicity itself. The free end of the cord is offered up to the insertion aperture (under the appropriate wing 70) and the spindle 74 is rotated. The free end of the cord will then be trapped by a nip 60 in the pulley and between the pulley 56 and the shoe 84 and will begin to wind onto the pulley 56. If the cord does not come free of the pulley once it reaches the other side of the doctor 66, the doctor blade 68 will strip it out of the groove 18. In this sense, the mechanism can be described as self-threading.

As has been explained in detail in the introduction to this application, the use of the pulley and shoe combination described obviates the need for "back-tensioning" of the cord. In addition, the dimensions of the groove and the distance between the pulley and the shoe can be optimised to provide a desired degree of resistance to rotation of the pulley or a desired maximum load rating. Clearly, the first should be as low as possible so as not to overload the motor; the second should be reasonably high to prevent slippage of the cord in normal use.

With the material and cord specifications as discussed above, a number of different groove sizes were experimented with, to give an indication of the amount of leeway available. The groove widths were varied by applying different amounts of pressure to the two halves of the pulley 56 during assembly. The results observed were as follows. "HEIGHT" indicates the maximum and minimum thicknesses of the complete pulley (an indicator of groove width); "TEST CURRENT" is the current draw required to drive the gearbox alone; "CORD CURRENT" is the lowest current draw required to drive the gearbox and cord; "SLIP CURRENT" is the current at which the cord slips in the groove, if held fast; and "LOAD" is the load in the cord at which the onset of slippage was seen.

| HEIGHT | TEST CURRENT | CORD CURRENT (mA) | | LOAD | SLIP CURRENT |
|---|---|---|---|---|---|
| (mm) | (mA) | CW | ACW | (gm) | (mA) |
| 9.00 | 54 | 79 | 86 | | 500+ |
| 9.10 | 53 | 69 | 71 | | 500+ |
| 9.12 | 55 | 67 | 73 | | 500+ |
| 9.15 | 54 | 66 | 72 | | 500+ |
| 9.15 | 55 | 68 | 74 | | 500+ |
| 9.15 | 53 | 67 | 71 | | 500+ |
| 9.16 | 57 | 67 | 73 | | 500+ |
| 9.25 | 54 | 62 | 65 | 2000+ | 500 |
| 9.35 | 53 | 57 | 60 | 600–800 | 180 |
| 9.40 | 50 | 57 | 60 | 400–600 | 80 |
| 9.55 | 50 | 57 | 60 | SLIPPED | SLIPPED |

From these figures, it can be seen that a compromise between good grip and low current draw can be achieved, in this case with a pulley thickness of 9.10–9.25 mm.

What is claimed is:

1. A method of installing a cord in a cord driving mechanism of a blind comprising a cord driving pulley having a circumferential, radially outward-facing groove comprising a plurality of radial nips, the nips defined by formations which are disposed opposite one another on respective sides of the groove and are positioned so that the path of a cord around the pulley is relatively straight and so that the cord is substantially unconstricted in the regions between the nips;

a doctor defining an insertion opening for the cord, the doctor being arranged adjacent the circumferential groove in the pulley and adapted to guide the cord out of the groove when the pulley is rotated; and a shoe relative to which the pulley rotates, which surrounds at least part of the circumferential groove in the pulley, the method comprising:

inserting a free end of the cord through the insertion opening of the doctor into a space defined by the circumferential groove and the shoe, and offering the free end up to a region of the groove between two of the nips;

rotating the pulley to entrain the cord; and retrieving the free end of the cord once it has passed around the pulley and is freed by the doctor.

2. A method of motorizing a blind operated by a manual control cord, the method comprising:

providing motor power to a cord driving mechanism, the cord driving mechanism comprising a cord driving pulley having a circumferential, radially outward-facing groove comprising a plurality of radial nips, the nips defined by formations which are disposed opposite one another on respective sides of the groove and are positioned so that the path of a cord around the pulley is relatively straight and so that the cord is substantially unconstricted in the regions between the nips; and a shoe relative to which the pulley rotates, which surrounds at least part of the circumferential groove in the pulley; and offering a free end of the manual control cord to the space defined by the circumferential groove and the shoe and rotating the pulley to entrain the cord.

3. A method according to claim 2 in which the mechanism includes a doctor arranged adjacent the circumferential groove in the pulley and adapted to guide the cord out of the groove when the pulley is rotated, further comprising retrieving the free end of the cord once it has passed around the pulley and is freed by the doctor.

4. A method according to claim 3 in which the doctor defines an insertion opening for the cord and the free end of the cord is offered up to that opening.

5. A method according to claim 2 in which the groove comprises a plurality of nips positioned around its circumference and the free end of the cord is offered up to the region of the groove between two of the nips.

6. A control mechanism for a blind comprising a cord for operating the blind;

a pulley for driving the cord, the pulley having a circumferential, radially outward-facing groove comprising a plurality of nips the nips, the nips defined by formations which are disposed opposite one another on respective sides of the groove and are positioned so that the path of a cord around the pulley is relatively straight and so that the cord is substantially unconstricted in regions between the nips;

a shoe relative to which the pulley rotates, which surrounds at least part of the circumferential groove in the pulley; and a motor for transmitting power to the pulley.

7. A control mechanism according to claim 6 in which the cord is not back-tensioned.

8. A control mechanism according to claim 6 in which the cord is retained in the groove by contact with the shoe.

9. A control mechanism according to claim 8 in which the dimensions of the groove, the spacing between the groove and the shoe, and the size of the cord are adapted to provide a desired resistance to rotation of the pulley and a desired maximum load which can be exerted on the cord.

10. A cord driving mechanism for a blind comprising:

a motor;

a cord driving pulley adapted to receive power transmitted from the motor, the pulley having a circumferential, radially outward-facing groove comprising a plurality of nips, the nips defined by formations which are disposed opposite one another on respective sides of the groove and are positioned so that the path of a cord around the pulley is relatively straight and so that the cord is substantially unconstricted in regions between the nips; and a shoe relative to which the pulley rotates, which surrounds at least part of the circumferential groove in the pulley.

11. A mechanism according to claim 10 in which the shoe surrounds at least half of the circumference of the pulley.

12. A mechanism according to claim 10 in which the nips are equidistantly spaced around the circumferential groove.

13. A mechanism according to claim 10 in which each of the nips is radial within the groove.

14. A mechanism according to claim 10 in which the nips are at least four in number.

15. A mechanism according to claim 14 in which the nips are twelve in number.

16. A mechanism according to claim 10 in which the formations are triangular teeth.

17. A mechanism according to claim 10 in which the formations are symmetric.

18. A mechanism according to claim 10 further including a doctor arranged adjacent the circumferential groove in the pulley and adapted to guide the cord out of the groove when the pulley is rotated.

19. A mechanism according to claim 18 in which the doctor is substantially symmetric.

20. A mechanism according to claim 19 in which the doctor defines an insertion opening for the cord.

* * * * *